US006145581A

United States Patent [19]

Takeuchi et al.

[11] Patent Number: 6,145,581

[45] Date of Patent: Nov. 14, 2000

[54] TWIN DRUM TYPE SHEET STEEL CONTINUOUS CASTING DEVICE AND CONTINUOUS CASTING METHOD THEREFOR

[75] Inventors: Tomohide Takeuchi; Tatsumi Saito; Kazuo Hamai; Kiyoshi Sawano; Masanobu Egashira, all of Futtsu, Japan

[73] Assignee: Nippon Steel Corporation, Tokyo, Japan

[21] Appl. No.: 09/171,189

[22] PCT Filed: Mar. 19, 1997

[86] PCT No.: PCT/JP97/00920

§ 371 Date: Oct. 14, 1998

§ 102(e) Date: Oct. 14, 1998

[87] PCT Pub. No.: WO98/35775

PCT Pub. Date: Aug. 20, 1998

[30] Foreign Application Priority Data

Feb. 17, 1997 [JP] Japan ..... 9/031758

[51] Int. Cl.[7] ..... B22D 11/06; B22D 11/07

[52] U.S. Cl. ..... 164/472; 164/268; 164/428; 164/480

[58] Field of Search ..... 164/480, 428, 164/472, 268

[56] References Cited

FOREIGN PATENT DOCUMENTS

| | | |
|---|---|---|
| 588743 | 3/1994 | European Pat. Off. . |
| 60-37562 | 7/1985 | Japan . |
| 61-154738 | 7/1986 | Japan . |
| 61-266160 | 11/1986 | Japan . |
| 63-90548 | 6/1988 | Japan . |
| 63-248547 | 10/1988 | Japan . |
| 4-81250 | 3/1992 | Japan . |
| 4-322850 | 11/1992 | Japan . |
| 5-318041 | 12/1993 | Japan . |
| 9-108788 | 4/1997 | Japan . |

*Primary Examiner*—Kuang Y. Lin
*Attorney, Agent, or Firm*—Kenyon & Kenyon

[57] ABSTRACT

While an insufficient lubricating effect caused by lack of lubricant is prevented and also while contamination of molten metal and insertion of molten metal caused by excessive feed of lubricant are prevented, a lubricating effect can be provided and continuous casting can be conducted over a long period of time. Molten metal is poured into a molten metal pool formed by a pair of cooling drums and side dams. The thus poured molten metal is cooled and solidified on circumferential surfaces of the cooling drums, so that a strip can be produced. In the above continuous strip casting method, the side dam is composed in such a manner that a portion of the ceramic plate on the inlet side in the rotational direction of the cooling drum is chamfered, wherein the portion comes into contact with an end surface of the cooling drum. Onto the end surface of the cooling drum at a position in the upstream on the inlet side of the side dam in the rotational direction of the cooling drum, solid lubricant is pushed at a temperature in the usable temperature range, so that lubricant can be continuously fed. While the lubricant is continuously fed in this way, continuous casting is carried out. In this case, the solid lubricant is pushed onto the drum end surface and continuously fed at the surface pressure of 2 to 15 kgf/cm$^2$ or at a pushing rate of 0.1 to 10 mm/min.

12 Claims, 13 Drawing Sheets

*AMOUNT OF ABRASION OF CERAMIC PLATE IN THE CASE OF SLIDING BY A DISTANCE OF 1m

※ RELATIVE VALUE IN THE CASE WHERE AN AMOUNT OF FUEL CONSUMPTION IS 1 WHEN BN AS A SIMPLE SUBSTANCE IS PUSHED AT A SURFACE PRESSURE OF 20 kgf/cm²

TWIN DRUM TYPE SHEET STEEL CONTINUOUS CASTING DEVICE AND CONTINUOUS CASTING METHOD THEREFOR

TECHNICAL FIELD

The present invention relates to a twin drum type strip casting apparatus, including a pair of cooling drums and for continuously casting a strip, in which a portion where an end surface of each cooling drum contacts a side dam can be effectively lubricated. Also, the present invention relates to continuous casting method for continuously casting a strip by the above twin drum type continuous strip casting apparatus.

BACKGROUND ART

Recently, a method for directly producing a strip with a thickness which is within several millimeters of the thickness of a final product, from a molten metal such as molten steel, has been studied with keen interest. When the above continuous casting method is adopted, unlike conventional continuous casting methods, it is not necessary to provide a hot rolling process including a large number of processing stages, and further it is sufficient to conduct rolling only lightly on the strip so as to obtain a final produce. Accordingly, it is possible to simplify the process and apparatus on the production line.

One of the continuous casting methods developed to accomplish the above object is a twin drum type continuous casting method disclosed in Japanese Unexamined Patent Publication (Kokai) No. 60-137562.

FIG. 1 is a perspective view to explain an outline of the above twin drum type continuous casting method. In this system, there are horizontally provided a pair of cooling drums 1*a,* 1*b* rotated in opposite directions. There is formed a recess portion between the cooling drums 1*a,* 1*b* and the side dams 2*a,* 2*b*. This recess portion is used as a molten metal pool 3 in which molten metal is accommodated. Molten metal is poured from a container such as a tundish into this molten metal pool 3 via a nozzle, and some of molten metal 4 accommodated in this molten metal pool 3 comes into contact with the cooling drums 1*a,* 1*b* and is cooled and solidified, so that a solidified shell can be formed.

This solidified shell is moved in accordance with the rotation of the cooling drums 1*a,* 1*b*. At a position where the pair of cooling drums 1*a,* 1*b* come most close to each other, that is, at a drum gap portion 6, the solidified shells respectively formed on the surfaces of the cooling drums 1*a,* 1*b* are pressed to each other, so that a target strip casting 5 can be obtained. In this case, reference numeral 15 is an end surface of the cooling drum, and reference numeral 16 is a sliding surface.

As disclosed in Japanese Unexamined Utility Model Publication (Kokai) No. 63-90548, each side dam 2*a,* 2*b* of this continuous sheet bar casting apparatus includes: a heat insulator accommodated in the side dam case; a base member attached to the heat insulator; and a ceramic plate attached to a portion of the base member corresponding to the cooling drum. Due to the foregoing arrangement, the side dam is pushed against the end surface of the cooling drum at the time of casting, and the ceramic plate is worn away when it comes into contact with the end surface of the cooling drum, so that a gap between the ceramic plate and the end surface of the cooling drum can be eliminated. Therefore, it is possible to prevent a leakage of molten steel. As disclosed in Japanese Unexamined Patent Publication (Kokai) No. 61-266160, in general, the side dam is oscillated, so that the abrasion of the ceramic plate can be accelerated.

In the above continuous strip casting apparatus, an amount of steel to be cast is determined by an abrasion speed of the ceramic plate of the side dam which slides on the end surface of the cooling drum. Therefore, it is very important to suppress the abrasion of the ceramic plate in order to increase an amount of steel to be cast.

The abrasion of the ceramic plate is affected by the factors such as its hardness, surface temperature and surface roughness. In order to suppress the abrasion of the ceramic plate, lubricant is fed onto the abrasion surface of the ceramic plate slidably coming into contact with the end surface of the cooling drum. Due to the foregoing, the abrasion can be reduced by the function of the lubricant, and further the surface temperature of the ceramic plate can be lowered and the end surface of the cooling drum can be made smooth. Accordingly, it is possible to reduce a coefficient of friction between the sliding surface of the cooling drum and the abrasion surface of the ceramic plate. As a result, it is possible to prevent the side dam from being opened. Therefore, the sealing property can be improved so as to prevent a leakage of molten steel.

Concerning the means for feeding lubricant onto the abrasion surface of the ceramic plate, Japanese Unexamined Patent Publication (Kokai) No. b 63-248547 discloses a method in which solid lubricant is pushed against the end surface of the cooling drum or the abrasion surface of the ceramic plate of the side dam by the operation of an air cylinder, or alternatively fine powder of solid lubricant dispersed in liquid is sprayed and made to adhere onto the end surface of the cooling drum or the abrasion surface of the ceramic plate of the side dam.

However, when a ordinary side dam is used and solid lubricant is simply made to adhere onto the sliding surface as disclosed in Japanese Unexamined Patent Publication (Kokai) No. 63-248547, a sufficient lubricating effect cannot necessarily be obtained at the sliding surface. That is, when an amount of lubricant that has adhered onto the end surface of the cooling drum is small, or even if the amount of lubricant is sufficiently large, when lubricant is scratched off by an inlet portion 11, which is indicated by an arrow in FIG. 2(*a*) and located on the inlet side in the rotational direction of the drum, of the side end ceramic plate coming into contact with the end surface of the cooling drum, it is impossible to obtain a sufficiently great lubricating effect. On the other hand, when an amount of solid lubricant that has adhered onto the end surface of the cooling drum is too great, lubricant that has exuded out from a gap between the end surface of the cooling drum and the sliding surface of the side end ceramic plate gets into the molten steel pool. Therefore, the molten steel is contaminated. When a gap between the end surface of the cooling drum and the side end ceramic plate is extended so as to prevent the above problem, molten steel tends to be inserted.

SUMMARY OF THE INVENTION

The present invention has been achieved to solve the above problems. It is an object of the present invention to provide a side dam which can perform an important lubricating function so that continuous casting can be stably carried out over a long period of time. Also, it is an object of the present invention to provide a continuous casting method by which continuous casting can be carried out by a continuous casting apparatus into which the above side dam is incorporated.

A summary of the present invention to accomplish the above object will be described as follows.

(1) A twin drum type continuous strip casting apparatus comprising: a pair of cooling drums; a pair of side dams arranged coming into contact with end surfaces of the cooling drums; a molten metal pool for accommodating molten metal, the molten metal pool being formed by the cooling drums and the side dams, wherein molten metal is poured into the molten metal pool and cooled and solidified on rotational circumferential surfaces of the cooling drums; and a lubricating mechanism for pushing solid lubricant against a sliding surface of the cooling drum, on which the side dam slides, so as to feed solid lubricant continuously, wherein a contact angle of the side dam plate and the end surface of the cooling drum in the rear of a position where solid lubricant is pushed against the sliding surface of the cooling drum is an acute angle or a configuration of the portion of the side dam plate is formed into a circular arc shape.

(2) A twin drum type continuous strip casting apparatus according to item 1, further comprising a guide pipe for guiding solid lubricant onto the sliding surface when solid lubricant is fed, the guide pipe including a water cooling means.

(3) A twin drum type continuous strip casting apparatus according to item 2, wherein solid lubricant is continuously fed onto the sliding surface of the cooling drum on which the side dam slides in a reducing gas atmosphere or inert gas atmosphere while reducing gas or inert gas is introduced inside the guide pipe.

(4) A method of continuous strip casting by the twin drum type continuous strip casting apparatus according to any one of items 1 to 3 comprising the step of pushing solid lubricant against the end surface of the cooling drum at a surface pressure of 2 to 15 kgf/cm$^2$.

(5) A method of continuous strip casting by the twin drum type continuous strip casting apparatus according to any one of items 1 to 3 comprising the step of pushing solid lubricant against the end surface of the cooling drum at a pushing speed of 0.1 to 10 mm/min.

(6) A method of continuous strip casting according to item 4 or 5, wherein the solid lubricant is a sintered body, comprising pores having porosity of 2 to 60%, and liquid lubricant in a temperature range in which the solid lubricant is used is impregnated into the pores.

(7) A method of continuous strip casting by a twin drum type continuous strip casting apparatus according to any one of items 4 to 6, wherein the solid lubricant is formed into a rod-shaped sintered body, at least one through-hole is formed in the sintered body in a longitudinal direction, and liquid lubricant in a temperature range in which the solid lubricant is used is embedded in the through-hole.

(8) A method of continuous strip casting by a twin drum type continuous strip casting apparatus according to any one of items 4 to 7, wherein the solid lubricant is pushed against and fed at a position in the front of a contact position of the end surface of the cooling drum with the side dam plate and separate from the side dam.

(9) A method of continuous strip casting by a twin drum type continuous strip casting apparatus according to any one of items 4 to 7, wherein the solid lubricant is pushed against and fed to a contact position of the end surface of the cooling drum with the side dam plate.

(10) A twin drum type continuous strip casting apparatus comprising: a pair of cooling drums; a pair of side dams made of self-lubricating ceramic, arranged in contact with end surfaces the cooling drums; a molten metal pool for accommodating molten metal, the molten metal pool being formed by the cooling drums and the side dams, wherein molten metal is poured into the molten metal pool and cooled and solidified on rotational circumferential surfaces of the cooling drums; and a lubricating mechanism for pushing solid lubricant against a sliding surface of the cooling drum, on which the side dam slides, so as to feed solid lubricant continuously, wherein a contact angle of the side end plate and the end surface of the cooling drum in the rear of a position where solid lubricant is pushed against the sliding surface of the cooling drum is an acute angle or a configuration of the portion of the side dam plate is formed into a circular arc shape.

(11) A method of continuous strip by the twin drum type continuous strip casting apparatus according to item 10 comprising the step of pushing solid lubricant against the end surface of the cooling drum at a surface pressure of 2 to 15 kgf/cm$^2$.

(12) A method of continuous strip casting by the twin drum type continuous strip casting apparatus according to item 10 comprising the step of pushing solid lubricant against the end surface of the cooling drum at a pushing speed of 0.1 to 10 mm/min.

BRIEF DESCRIPTION OF THE DRAWINGS

FIGS. 2(*b*) and 2(*c*) are enlarged cross-sectional views of examples of the structure of the side dam of the present invention.

BEST MODE FOR CARRYING OUT THE INVENTION

The characteristic of the present invention is described as follows. In this twin drum type continuous strip casting apparatus, there is provided a molten metal pool, in which molten metal is accommodated, in a region formed by a pair of cooling drums and a pair of side dams. Molten metal is poured into this molten metal pool. While molten metal is cooled and solidified on the rotational circumferential surfaces of the cooling drums, a strip can be produced. Solid lubricant is successively fed onto the side dam while solid lubricant is being pushed against the sliding surface between the cooling drum and the side dam. A shape of the side end plate is formed in such a manner that a distance from the side dam to the drum end surface is gradually reduced when it comes to a start point of contact. The present invention provides the structure of the above lubricating side dam incorporated into the continuous strip casting apparatus.

Figure 1:
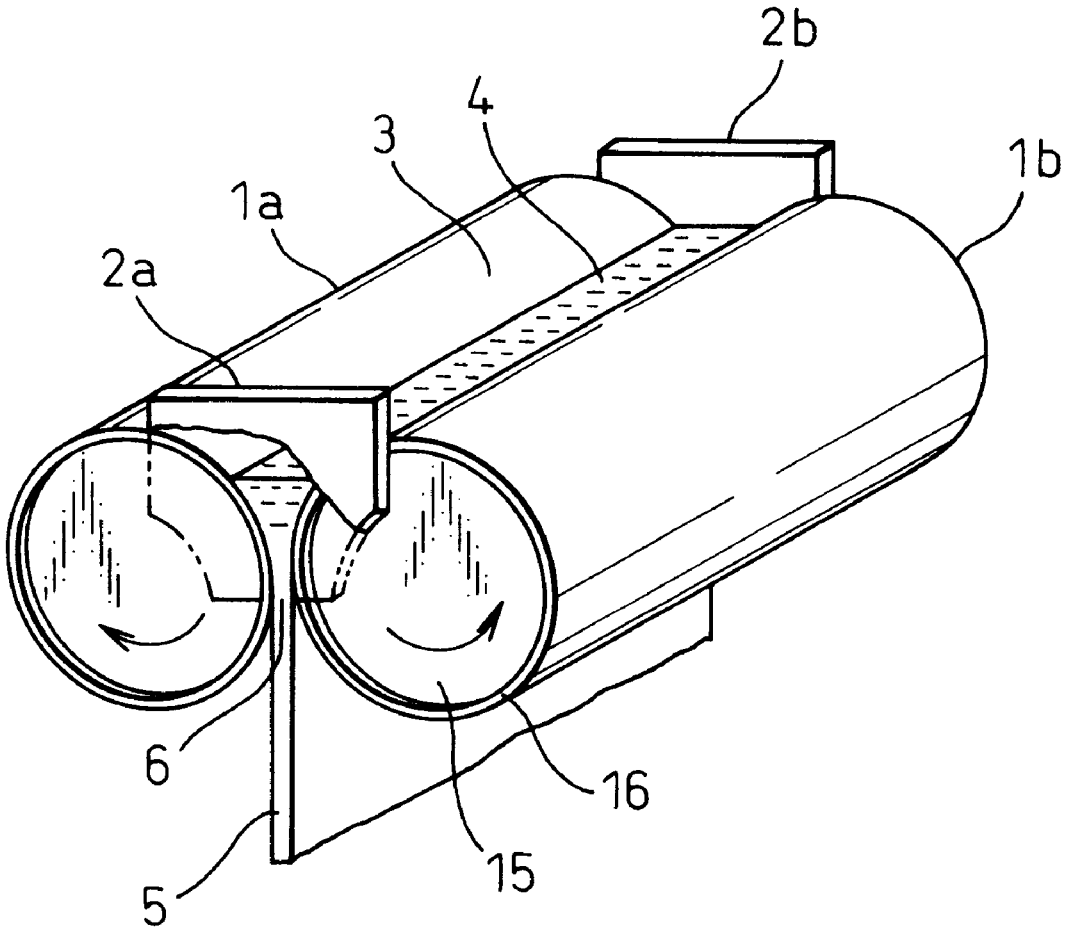
FIG. 1 is a perspective view showing an outline of the conventional twin drum type continuous strip casting apparatus.
Figure 2A:
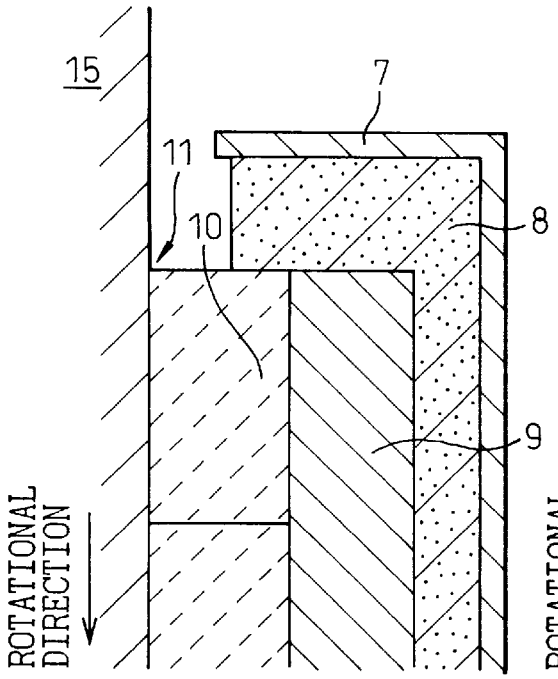
FIG. 2(*a*) is an enlarged cross-sectional view of an example of the structure of the conventional side dam.
Figure 2B:
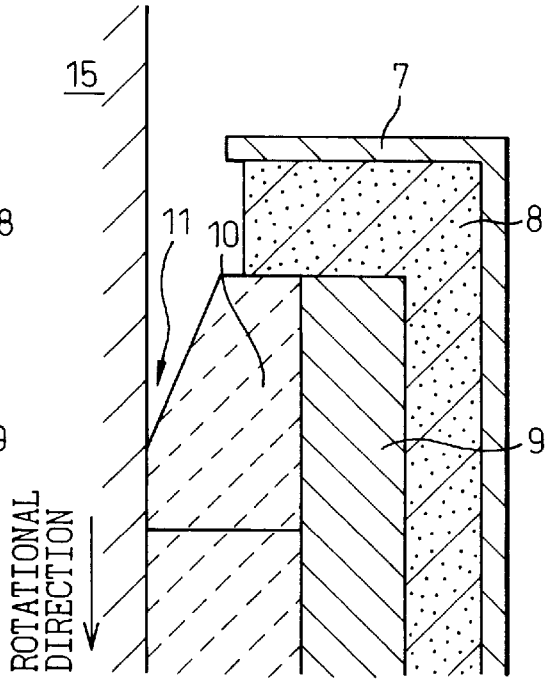
Figure 2C:
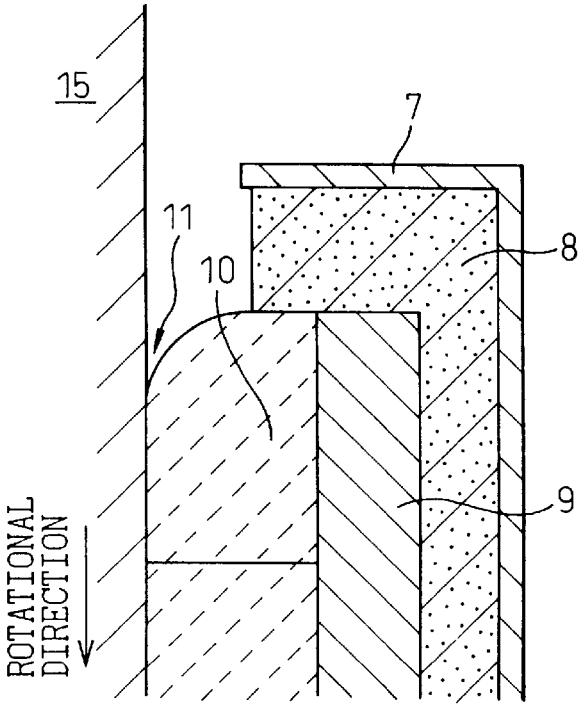
Figure 3:
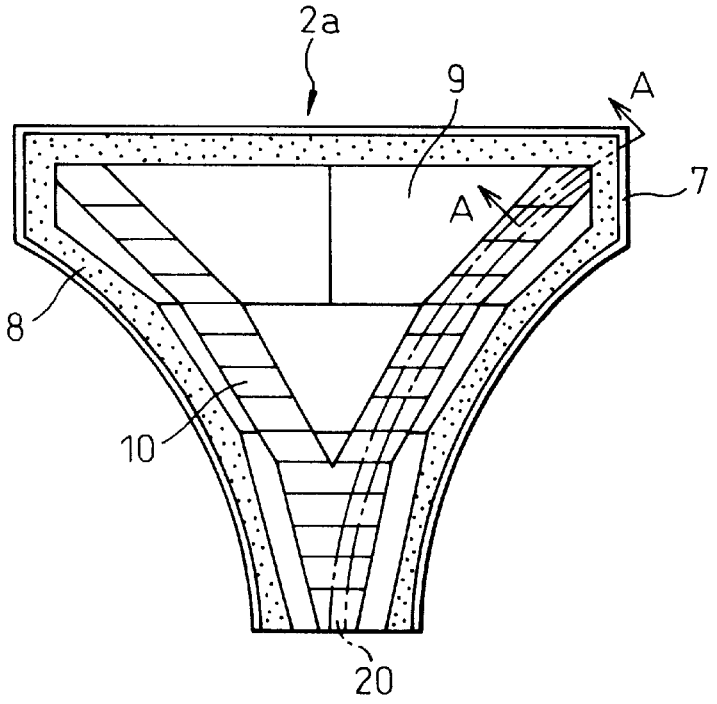
FIG. 3 is a front view showing an arrangement of the conventional side dam.

The side dam 2*a* illustrated in FIG. 3 is composed as follows. There is provided a side dam case 7 outside the side dam 2*a*. Inside the side dam 2*a,* there are successively provided an insulator 8 accommodated in the side dam case 7, a base member 9 and a ceramic plate 10 attached to the base member 9. The ceramic plate 10 is arranged along an abrasion surface 20 which directly slides on the sliding surface 16 of the cooling drum end surface 15. According to the present invention, as illustrated in FIGS. 2(*b*) and 2(*c*), an inlet portion 11 of the ceramic plate 10 on the inlet side in the rotational direction of the cooling drum is chamfered by a plane or a curved surface. In this connection, FIG. 2(*a*) is a view showing a conventional ceramic plate 10, the inlet portion 11 of which on the inlet side in the rotational direction of the cooling drum is not chamfered.

Figure 4:
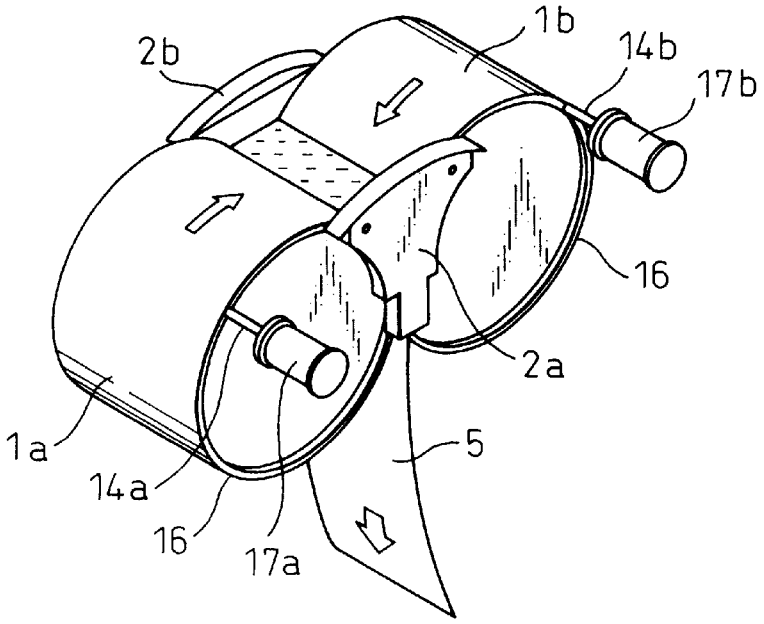
FIG. 4 is a perspective view showing an outline of the solid lubricant pushing device of the present invention.

FIG. 4 is a view showing an example of the solid lubricant pushing device used in the present invention. In this solid lubricant pushing device, pieces of solid lubricant 14*a,* 14*b* are pushed against the sliding surface 16 of the cooling drum end surface by the cylinders 17*a,* 17*b* at a predetermined surface pressure.

It should be noted that the pushing device is not limited to the specific example. As long as the pieces of solid lubricant can be pushed against the cooling drum sliding surface 16 at a predetermined pressure, extension springs and others may be used instead of the cylinders 17*a,* 17*b*.

Examples of usable material of the ceramic plate in the present invention are: BN, BN—$Si_3N_4$, BN—AIN, BN—AIN—$Si_3N_4$, BN—AIN—SiC, BN—AIN—$Si_3N_4$—SiC, $Al_2O_3$—C, $Al_2O_3$—SiC—C, MgO—C, MgO—SiC—C, and $Al_2O_3$—$Cr_2O_3$—$ZrO_2$. Examples of usable lubricant are: BN, graphite, molybdenum disulfide, tungsten disulfide, mica, talc, and $CaCO_3$.

Referring to the attached drawings, the principle of the present invention will be explained below.

Figure 5:
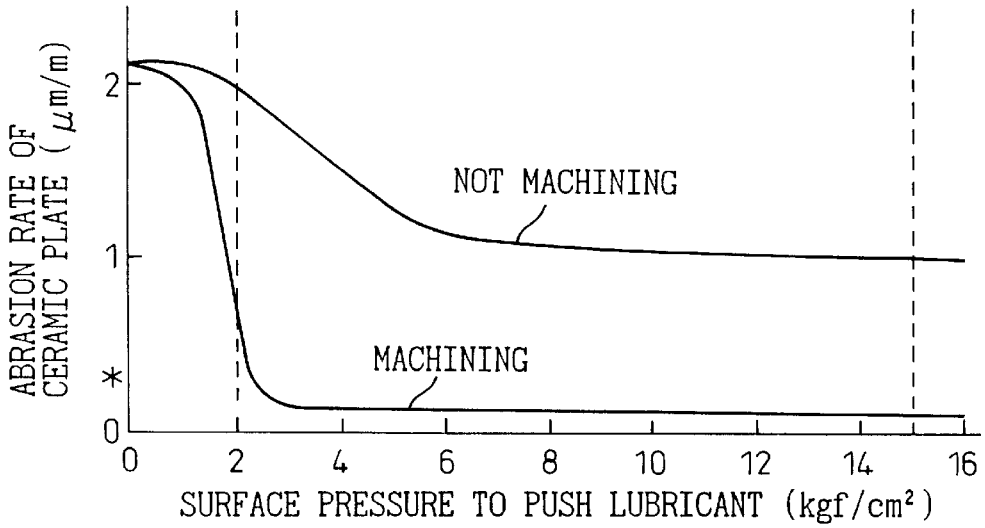
FIG. 5 is a graph showing a relation between the pushing surface pressure given to solid lubricant and the abrasion rate of the ceramic side dam plate.

FIG. 5 is a graph showing a relation between the pushing surface pressure given to solid lubricant BN and the abrasion rate of the ceramic plate of the side dam, wherein the abrasion rate of the ceramic plate is the most important index to indicate the lubricating effect of lubricant. On this graph, there are shown two cases. One is a case in which a portion of the ceramic plate of the side dam on the inlet side in the rotational direction of the drum is chamfered by a plane or a curved surface, and the other is a case in which a portion of the ceramic plate of the side dam on the inlet side in the rotational direction of the drum is not chamfered. In this connection, there is no difference between the plane and the curved surface when the portion of the ceramic plate is chamfered. Accordingly, the two cases are shown by one curve on the graph.

When the portion of the ceramic plate of the side dam on the inlet side in the rotational direction of the drum is chamfered by a plane or a curved surface, solid lubricant can be smoothly fed into a clearance between the sliding surface of the cooling drum and the abrasion surface of the ceramic plate. On the other hand, when chamfering is not conducted on the portion, lubricant is scraped off by the portion of the ceramic plate on the inlet side in the rotational direction of the cooling drum, so that lubricant can not be smoothly fed onto the sliding surface. Therefore, it is necessary to perform a lubricating function by increasing the pushing surface pressure so as to make the lubricant adhere to the sliding surface of the cooling drum more strongly.

In this connection, according to the first invention, it is preferable the acute angle is in a range from 1 to 60°. When the acute angle is less than 1° or more than 60°, lubricant is scraped off, so that it cannot be sufficiently applied to the sliding surface.

Although the absolute value is a little different depending upon the physical property of solid lubricant, when the surface pressure given to lubricant is lower than 2 kgf/cm$^2$, the amount of lubricant adhering onto the sliding surface is small. Accordingly, it is impossible to feed a sufficiently large amount of lubricant into a clearance between the sliding surface of the cooling drum and the abrasion surface of the ceramic plate. As a result, it is impossible to perform a sufficiently great lubricating function.

Figure 6:
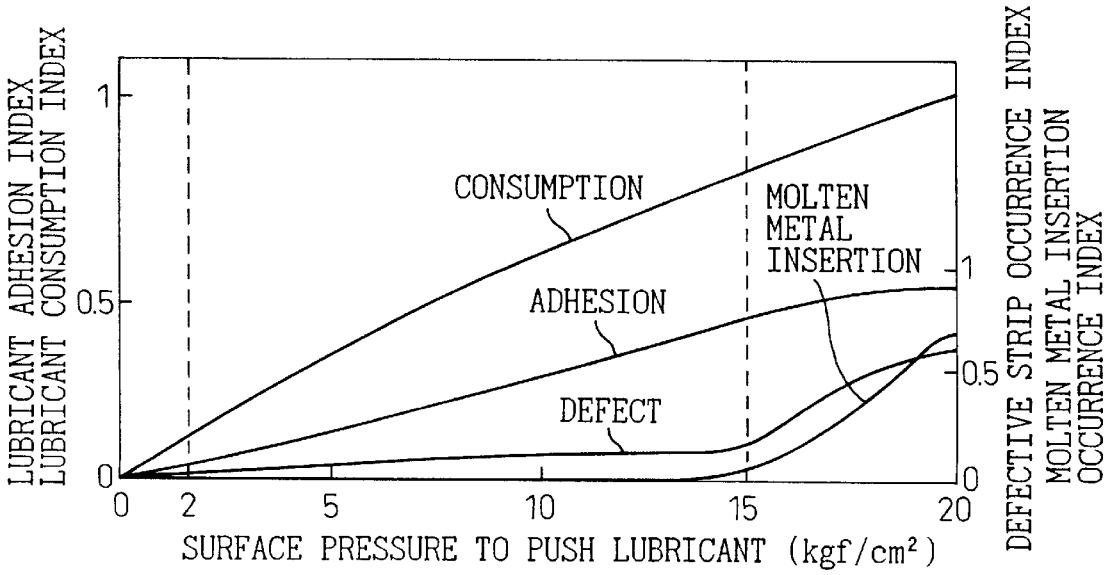
FIG. 6 is a graph showing a relation between the pushing surface pressure given to solid lubricant and the lubricant consumption index, a relation between the pushing surface pressure given to solid lubricant and the lubricant adhesion index onto the drum sliding surface, a relation between the pushing surface pressure given to solid lubricant and the defective strip casting occurrence index caused by lubricant, and a relation between the pushing surface pressure given to solid lubricant and the molten metal insertion index.

FIG. 6 is a graph showing a relationship between the pushing surface pressure given to solid lubricant BN and the lubricant consumption index, a relationship between the pushing surface pressure given to solid lubricant BN and the lubricant adhesion index onto the drum sliding surface, a relationship between the pushing surface pressure given to solid lubricant BN and the defective strip casting occurrence index caused by lubricant, and a relationship between the pushing surface pressure given to solid lubricant BN and the molten metal insertion index. In this case, the lubricant consumption index and the lubricant adhesion index are relative values when an amount of consumed lubricant is 1 in the case where the pushing surface pressure is 20 kgf/cm$^2$. The defective strip occurrence index and the molten metal insertion index are relative occurrence frequencies in the case where the number of all tests is assumed to be 1.

An amount of consumed solid lubricant is increased in accordance with an increase in the pushing surface pressure. On the other hand, concerning the amount of consumed lubricant, when consideration is given to an amount of lubricant that has adhered onto the sliding surface of the drum, it increases in proportion to an increase in the pushing surface pressure given to lubricant until the pushing surface pressure reaches 15 kgf/cm$^2$. However, when the pushing surface pressure has reached 15 kgf/cm$^2$, an amount of lubricant that has adhered onto the sliding surface is saturated, that is, the amount of lubricant that adheres onto the sliding surface is not increased any more. In other words, when a predetermined pushing surface pressure is given, a sufficiently large amount of lubricant can be made to adhere onto the sliding surface of the drum so as to perform a required lubricating function. Even if a surface pressure higher than the predetermined pushing surface pressure is given, the lubricating function can not be accelerated, and the lubricating cost is raised.

When the pushing surface pressure is raised and the lubricant consumption is increased, an amount of lubricant exuding out into molten steel from the sliding portion between the drum end surface and the ceramic plate is increased. Lubricant that has exuded out in this way is involved in sheet bars, and the occurrence of defective strip is rapidly increased as illustrated in FIG. 6. When an amount of lubricant adhering onto the sliding surface of the drum is increased, thickness of the adhering lubricant layer is also increased. Accordingly, a gap between the drum end surface and the ceramic plate is increased. As a result, as illustrated in FIG. 6, the insertion of molten steel into the gap between the drum end surface and the ceramic plate is actively caused, which causes problems in the continuous casting operation.

Concerning the relationship between the operation to push the side dam plate and the lubricating effect, when the ceramic plate of the side dam plate is made of soft material of BN, abrasion of the ceramic plate proceeds in accordance with a pattern of pushing the side dam. Therefore, the soft material of BN is excellent in the sealing property to stop a leakage of molten steel. However, unless the side dam is continuously pushed, the sealing property is deteriorated. According to the result of an experiment made by the inventors, the following were found. If the surface pressure given onto the side dam was not higher than 2 kg/cm$^2$, the sealing property to stop a leakage of molten steel could not be ensured. When solid lubricant was added and the lubricating function was performed, it was possible to ensure a surface pressure higher than 2 kg/cm$^2$ even if the side dam was not continuously pushed. The longer the sliding distance was increased, the more the abrasion of the ceramic plate was suppressed.

For the reasons described above, according to the present invention, a portion of the ceramic plate of the side dam on the inlet side in the rotational direction of the cooling drum is chamfered to be a plane or a curved surface, and a piece of solid lubricant is pushed by a surface pressure in a range from 2 to 15 kgf/cm$^2$. It is possible to obtain a predetermined lubricating effect, and continuous casting can be performed over a long period of time.

Depending upon a type of solid lubricant, the mechanical strength of a body formed by the solid lubricant is low, and it is impossible to stably feed the lubricant onto the sliding surface by controlling the surface pressure. In the above case, when the pushing rate is controlled to be in a range from 0.1 to 10 mm/min, it is possible to feed the solid lubricant. However, when the pushing rate is lower than 0.1 mm/min, an amount of lubricant adhering onto the drum sliding surface is small, and it is impossible to feed a sufficiently large amount of lubricant into a gap between the sliding surface of the cooling drum and the abrasion surface of the ceramic plate. Due to the foregoing, it is impossible to provide a sufficiently high lubricating effect. For the above reasons, the lower limit of the pushing rate is set at 0.1 mm/min. On the other hand, when the pushing rate is increased to a value higher 10 mm/min, an amount of lubricant adhering onto the sliding surface of the drum is saturated, so that the lubricating effect can not be accelerated and further the lubricating cost is raised. Furthermore, an amount of lubricant exuded out into molten steel is increased, and the occurrence of defective sheet bars is increased. Therefore, the upper limit of the pushing rate is set at 10 mm/min.

Figure 7:
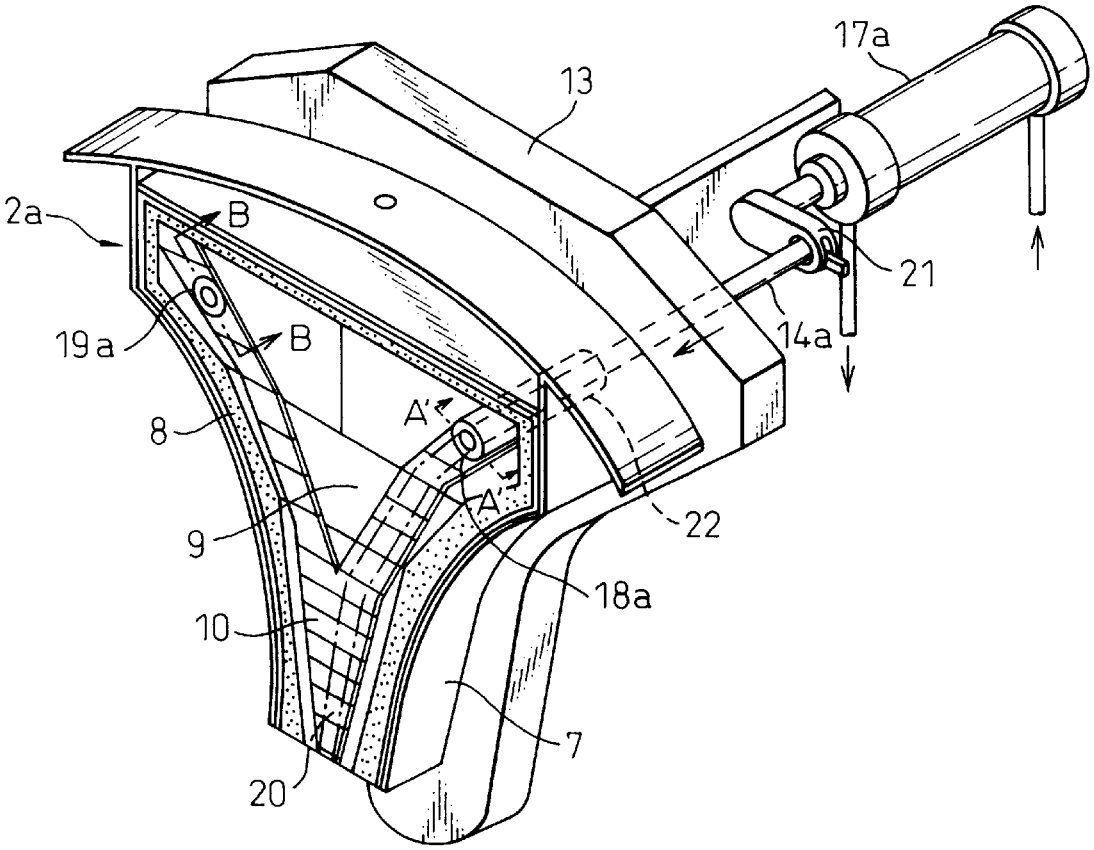
FIG. 7 is a perspective view of the guide pipe of the solid lubricant pushing device of the present invention.
Figure 8:
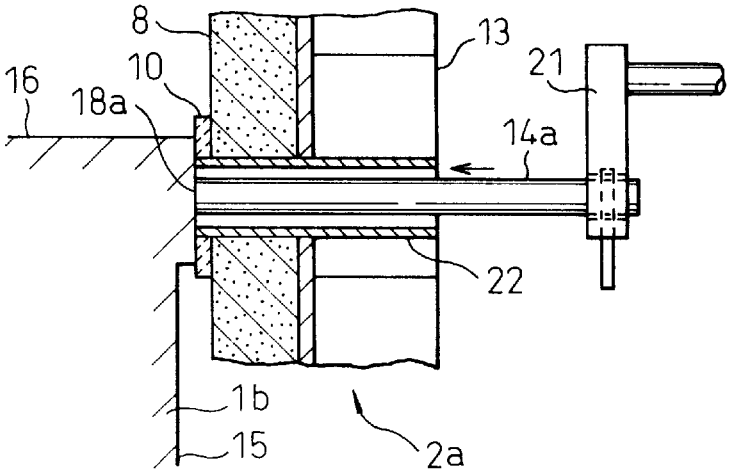
FIG. 8 is an enlarged cross-sectional view taken on line A'—A' in FIG. 7, which shows a structure with the end surface of the cooling drum.
Figure 9:
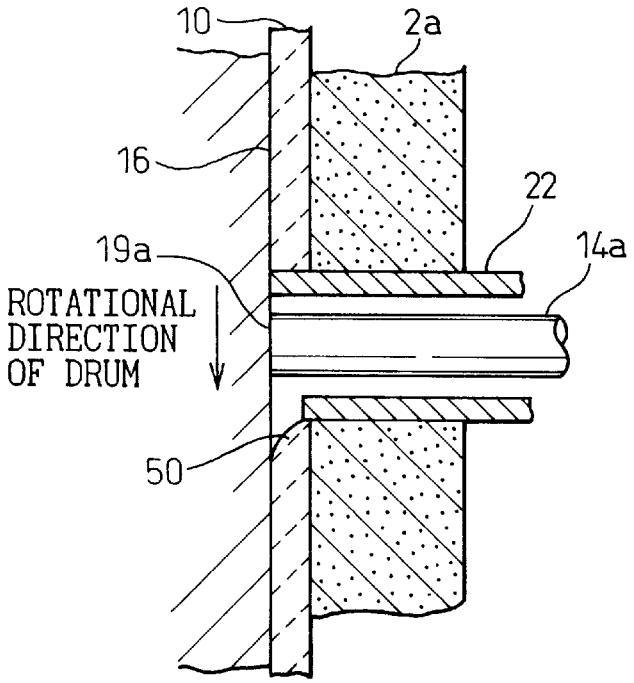
FIG. 9 is an enlarged cross-sectional view taken on line B—B in FIG. 7, which shows a structure with the end surface of the cooling drum.

Next, a system will be explained in which a sintered body of lubricant is set on the side dam. FIGS. 7, 8 and 9 are views for showing an outline of the system. As illustrated in these views, the ceramic plate 10 is attached onto a surface coming into contact with the sliding surface 16 of the cooling drum end surface 15, that is, the ceramic plate 10 is attached along the abrasion surface 20. There are formed lubricant feed ports at the two positions 18*a*, 19*a* on the abrasion surface 20 located in an upper portion of the side dam, wherein this upper portion is not contacted with molten steel. A section 50 of the ceramic plate of this lubricant feed port on the downstream side in the rotational direction of the cooing drum is formed into a curved surface, so that the fed lubricant can be easily get into between the drum end surface 15 and the ceramic plate 10.

In the lubricant feed port, there is provided a guide pipe 22 into which a piece of lubricant 14*a* is movably inserted. The lubricant pushing device is composed of a cylinder 17*a* and a lubricant supporting portion 21 attached to a front end of the rod of the cylinder 17*a*. The piece of lubricant 14*a* is supported by the supporting portion 21 and pushed against the sliding surface 16 of the cooling drum end surface at a predetermined surface pressure. As long as the pushing device can push the piece of lubricant against the sliding surface at a predetermined surface pressure, any type pushing device may be adopted. Reference numeral 13 is an oscillating device to oscillate the side dam.

There is provided an explanation of a case in which the piece of lubricant is arranged at a position on the side dam and a water cooling means is arranged in the guide pipe.

Figure 10:
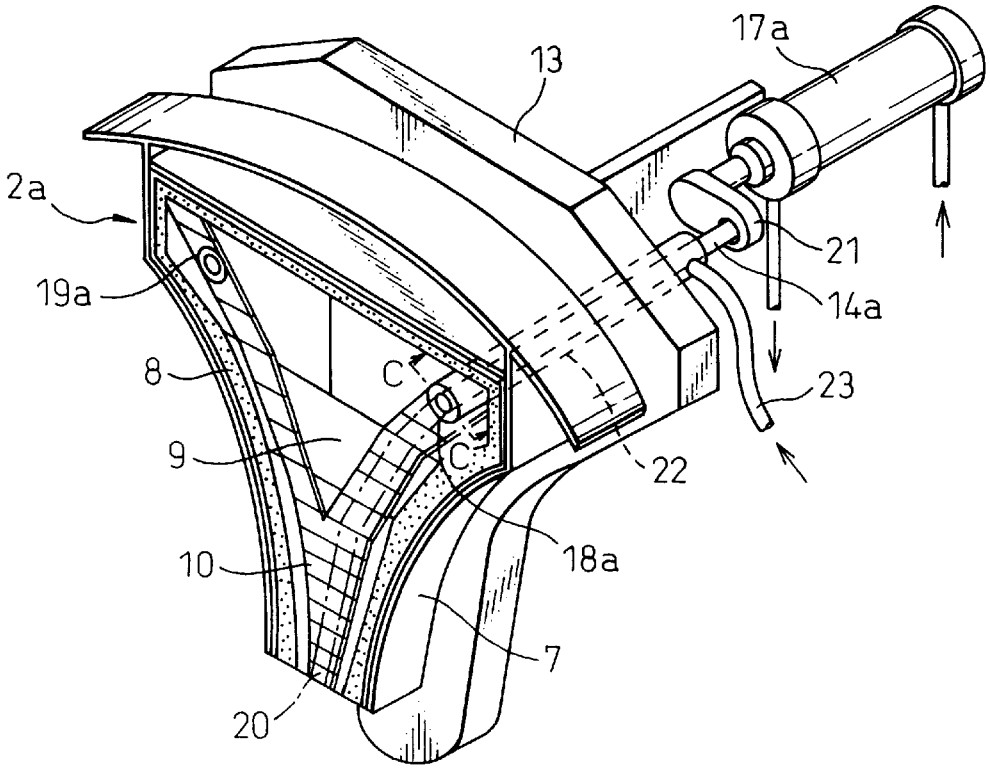
FIG. 10 is a perspective view showing an outline of the atmosphere of inert gas in the solid lubricant pushing device of the present invention.
Figure 11:
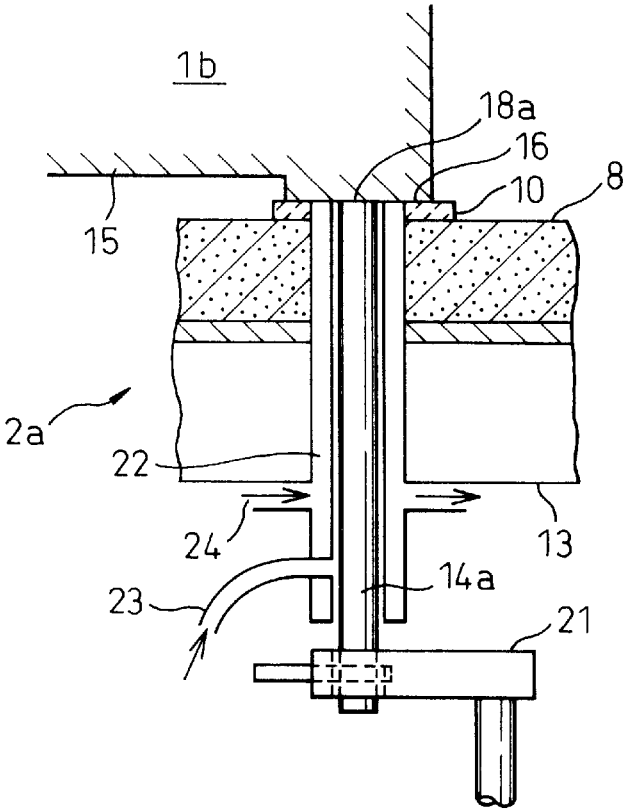
FIG. 11 is an enlarged cross-sectional view taken on line C—C in FIG. 10, which shows a structure with the end surface of the cooling drum.

FIGS. 10 and 11 are views showing an outline of the case. As illustrated in these views, at the feed port, there is provided a guide pipe 22, in to which the cooling means is incorporated, penetrating the side dam 2*a*. A piece of solid lubricant 14*a* is inserted into this guide pipe 22. A gas introducing pipe 23 for introducing inert gas is connected with this guide pipe 22, and water 24 is made to flow outside the guide pipe 22 so that it can be water-cooled.

The cooling condition of lubricant is described as follows. When the solid lubricant is not cooled. Its temperature is 1200° C. (since the guide pipe penetrates the side dam, the temperature of which is very high), and when the solid lubricant is cooled, its temperature is not higher than 150° C. Due to the foregoing, it is possible to use solid lubricant such as graphite, molybdenum disulfide and tungsten disulfide, the heat resistance of which is low, at a temperature lower than a temperature range in which its mechanical strength is lowered. Concerning the atmosphere in the case of introducing inert gas into the apparatus, when nitrogen gas or Ar gas is introduced, it is possible to reduce the oxygen concentration to a value not more than 0.5%. Due to the foregoing, it is possible to prevent a solid lubricant such as graphite, molybdenum disulfide and tungsten disulfide, the anti-oxidation property of which is low, from being oxidized.

The lubricant pushing device is composed of a cylinder 17*a* and a lubricant supporting portion 21 attached to a front end of the rod of the cylinder 17*a*. The piece of lubricant 14*a* is supported by the supporting portion 21 and pushed against the sliding surface 16 of the cooling drum end surface at a predetermined surface pressure.

Next, the characteristic of the lubricant will be explained below.

Figure 12:
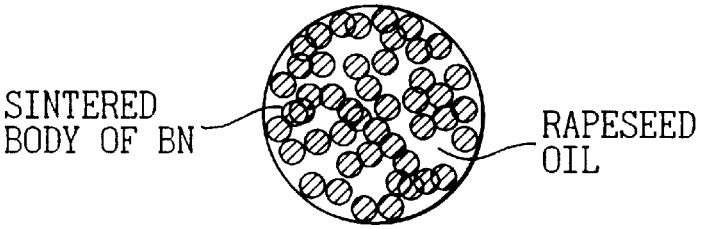
FIG. 12 is a schematic cross-sectional view showing an example of solid lubricant of the present invention.
Figure 13:
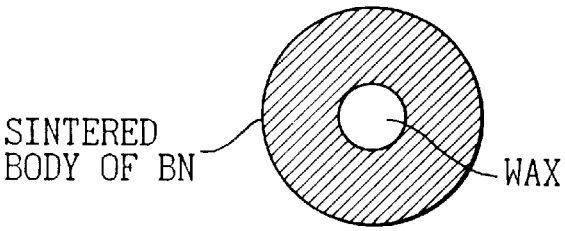
FIG. 13 is a schematic cross-sectional view showing another example of solid lubricant of the present invention.
Figure 14:
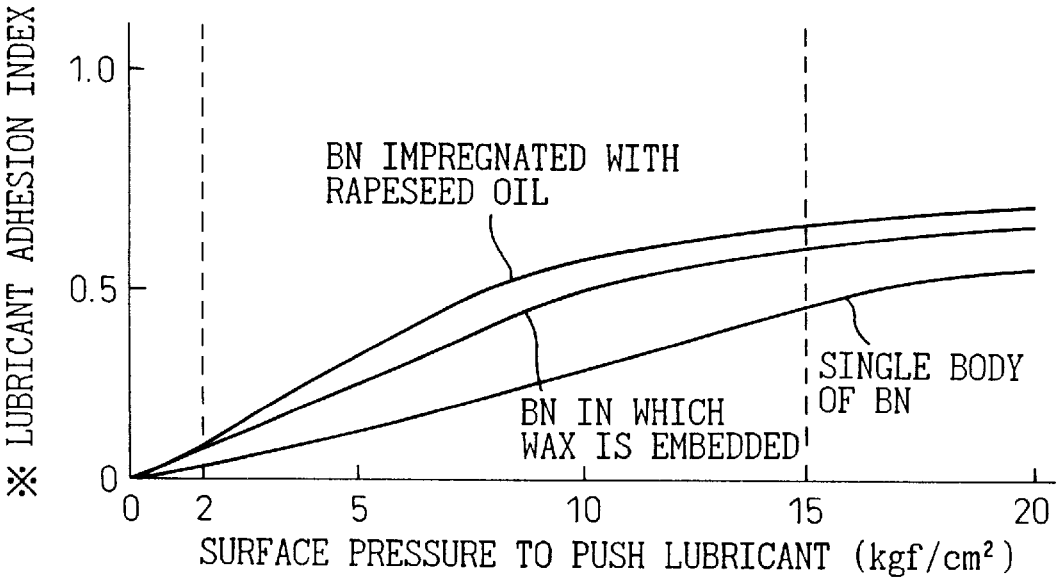
FIG. 14 is a graph showing a relationship between the pushing surface pressure given to solid lubricant and the lubricant adhesion index onto the sliding surface of the drum.

According to the present invention, a body of solid lubricant (illustrated in FIG. 12) is used. The solid lubricant is formed in such a manner that pores of a sintered body of BN (forming body) are impregnated with lubricant which is liquid in the usable temperature range. Also, a body of solid lubricant (illustrated in FIG. 13) is used which is formed in such a manner that a through-hole formed in a rod-shaped sintered body (forming body) of BN in the longitudinal direction is filled with lubricant which is liquid in the usable temperature range. When the above sintered body of solid lubricant is used, the adhesion efficiency of BN onto the drum sliding surface is enhanced (illustrated in FIG. 14) as compared with a case in which BN is used as a simple substance. Due to the foregoing, the lubricating effect can be accelerated under the condition of the same pushing surface pressure. Accordingly, it is possible to decrease the consumption of lubricant. Therefore, the cost can be reduced.

In order to accelerate the adhesion efficiency of solid lubricant by the impregnated lubricant, the porosity of the sintered body must be at least 2%. From the viewpoint of maintaining the rigidity, it is preferable that the porosity of the sintered body is not higher than 60%.

Material of the sintered body of solid lubricant is not limited to BN. For example, material having a self-lubricating property such as graphite, mica, tungsten disulfide, molybdenum disulfide, talc or $CaCO_3$ may be used.

A substance to be impregnated or a substance to be embedded may be a lubricant which is liquid in the usable temperature range such as lubricating oil, grease, wax and glass of which the melting point is not more than 600° C.

An example of the present invention will be explained below.

Concerning the amount of abrasion of the ceramic plate, when the amount of abrasion is not more than 0.7 mm in the case of sliding by a distance of 3 km, it is possible to conduct casting of 360 ton by one casting operation. In this case, it is preferable that the amount of abrasion of the drum end surface is not more than 10 $\mu$m per 3 km. The consumption of lubricant is not more than 0.4 mm/min in the case of BN (the consumption of lubricant is 20 mm in the case of sliding by a distance of 3 km). When the surface pressure is controlled by pushing the sintered body of lubricant, soft material tends to be consumed quickly.

EXAMPLES

Example 1

As an example, the following experiment was made. The water-cooled drums 1*a,* 1*b* used in the experiment were made of SUS304. The ceramic plate 10 of the side dam was made of BN: 50% and AlN: 50%. The pushing surface pressure of the side end plate against the end surface of the water-cooled drum was 3 kg/cm$^2$. The casting rate was 80 m/min. The contact length of the ceramic plate 10 with the sliding surface 16 of the end surface 15 of the water-cooled drum was 470 mm.

An end portion of the ceramic plate, the thickness of which was 10 mm, at the lubricant feed port on the downstream side in the rotational direction of the cooling drum was chamfered at 10 mmR as indicated by reference numeral 50 in FIG. 9.

Figure 15:
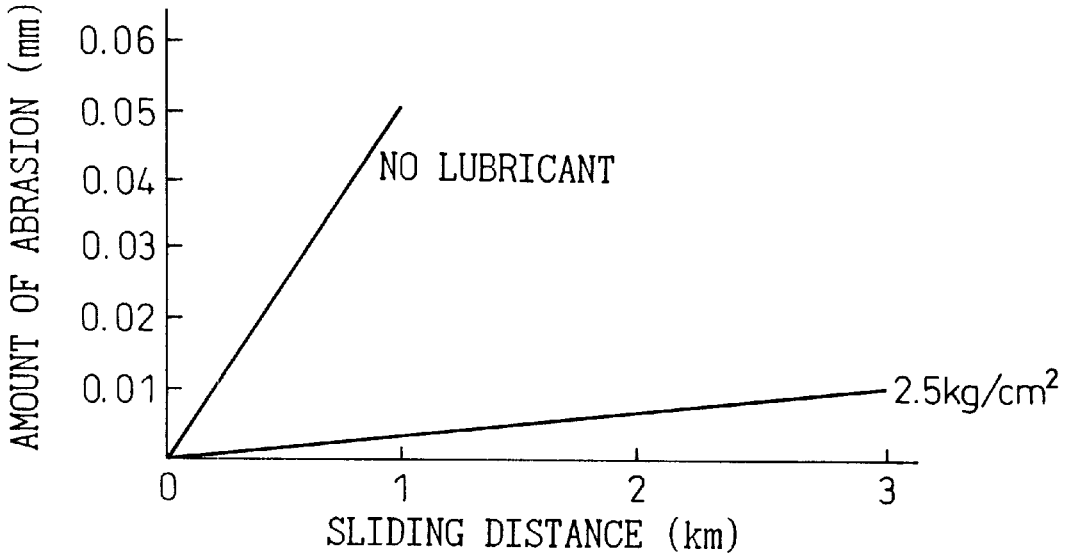
FIG. 15 is a graph showing a relationship between the sliding distance and the amount of abrasion of the end surface of the drum in Example 1.
Figure 16:
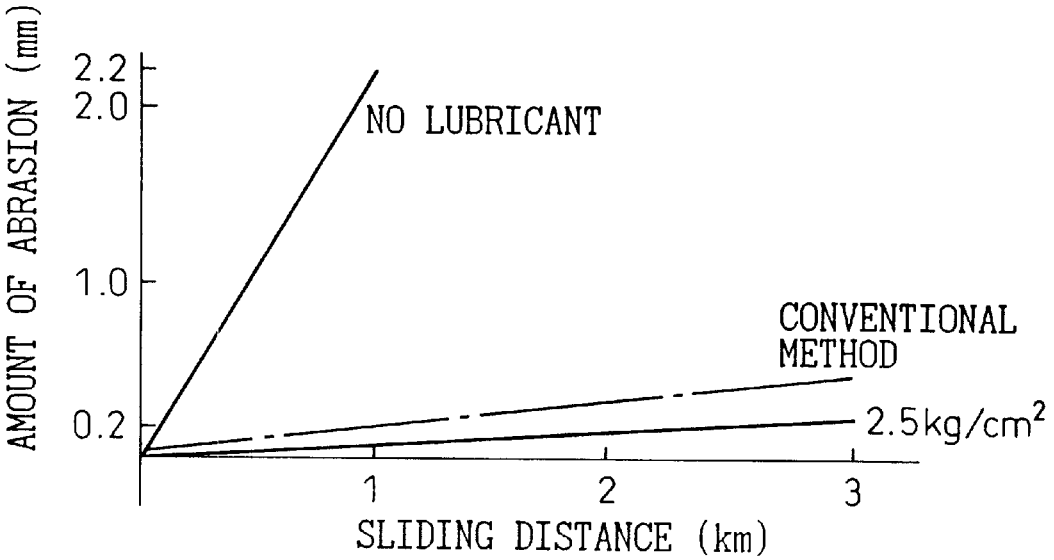
FIG. 16 is a graph showing a relationship between the sliding distance and the amount of abrasion of the ceramic plate in Example 1.

In this apparatus, there was used a piece of solid lubricant, the section of which was circular, made of material of BN sintered by means of hot-press. This solid lubricant was pushed against the cooling drum sliding surface 16 by a surface pressure of 2.5 kg/cm$^2$ for forcible lubrication. FIG. 15 is a graph showing a relation between the sliding distance and the amount of abrasion of the drum end surface. FIG. 16 is a graph showing a relation between the sliding distance and the amount of abrasion of the ceramic plate 10. In both cases, great effects were provided by using the lubricant.

Figure 17:
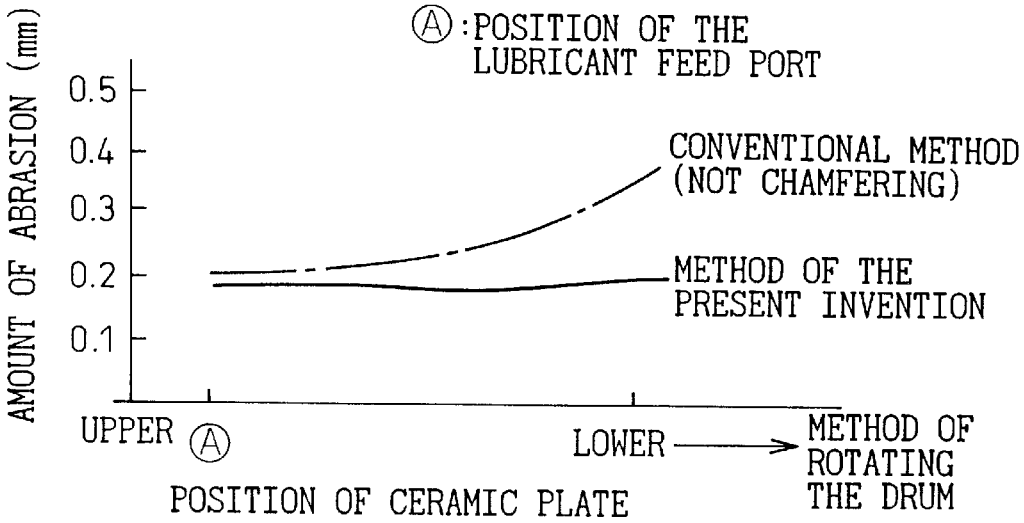
FIG. 17 is a graph showing a relationship between the position of the ceramic plate and the amount of abrasion of the ceramic plate in Example 1.

In FIG. 17, there is shown a profile of the ceramic plate 10, which was worn away, in a region from the lubricant feed port to the sliding position at the lowermost end of the ceramic plate. Concerning the profile of the ceramic plate 10 which was worn away, when the lubricant feed port was not chamfered by R, an amount of abrasion at a position close to the lubricant feed port was small, however, the abrasion is increased in proportion to an increase in the sliding distance. This shows the effect of the present invention in which lubricant got onto the sliding surface.

Example 2

In Example 2, the experiment was made under the following conditions. The same continuous strip casting apparatus was used. There were prepared cylindrical pieces of solid lubricant, the outer diameter of which was 10 mm, made of graphite and molybdenum disulfide. Water was made to flow in the water-cooling pipe of the guide pipe. While the side end plate was being pushed against the sliding surface of the water-cooled drum at the predetermined surface pressure, lubrication was forcibly conducted.

Figure 18:
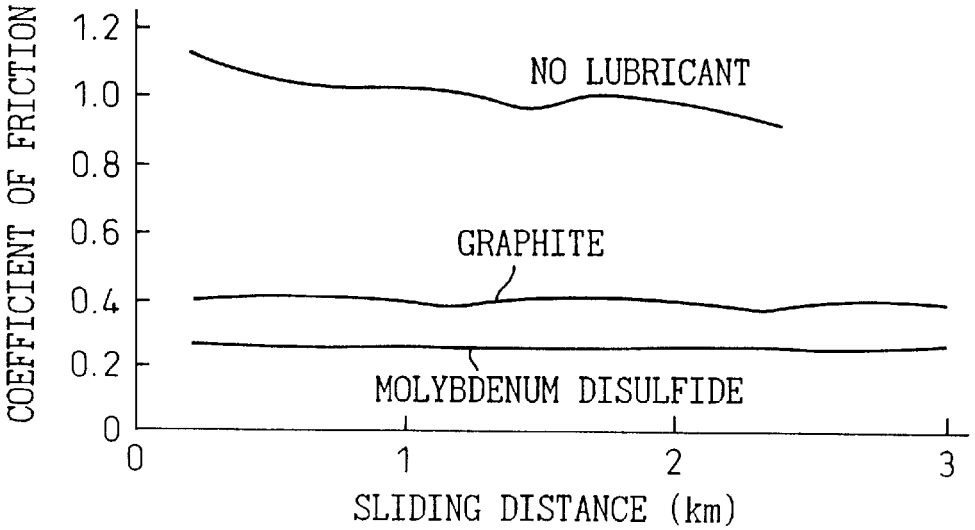
FIG. 18 is a graph showing a relationship between the sliding distance and the coefficient of friction in Example 2.

A coefficient of friction between the sliding surface of the water-cooled drum and the abrasion surface of the ceramic member was found by a value of torque of the water-cooled drum and shown in FIG. 18. Compared with Comparative Example in which the solid lubricant was not used, the coefficient of friction was greatly reduced in the present invention.

Figure 19:
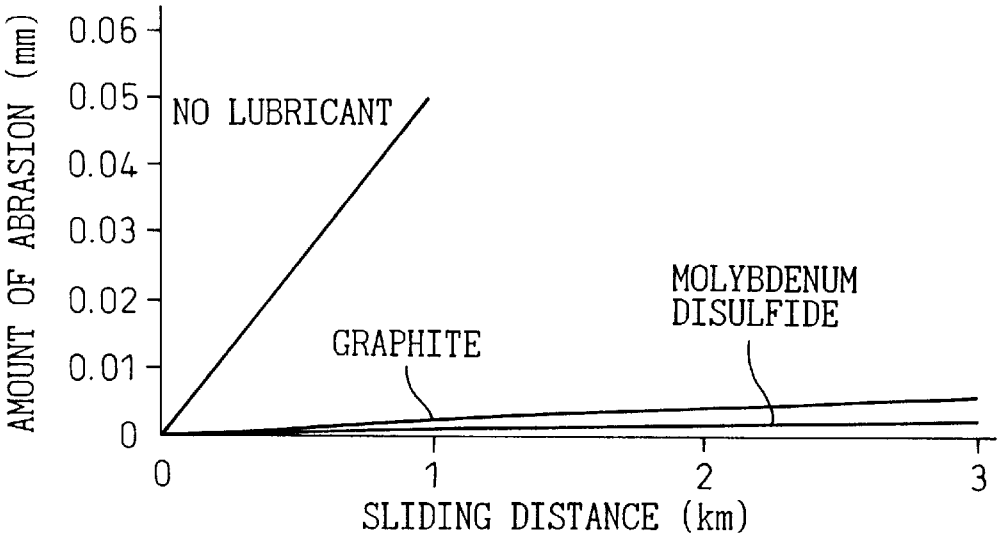
FIG. 19 is a graph showing a relationship between the amount of abrasion of the sliding surface of the drum and the sliding distance in Example 2.
Figure 20:
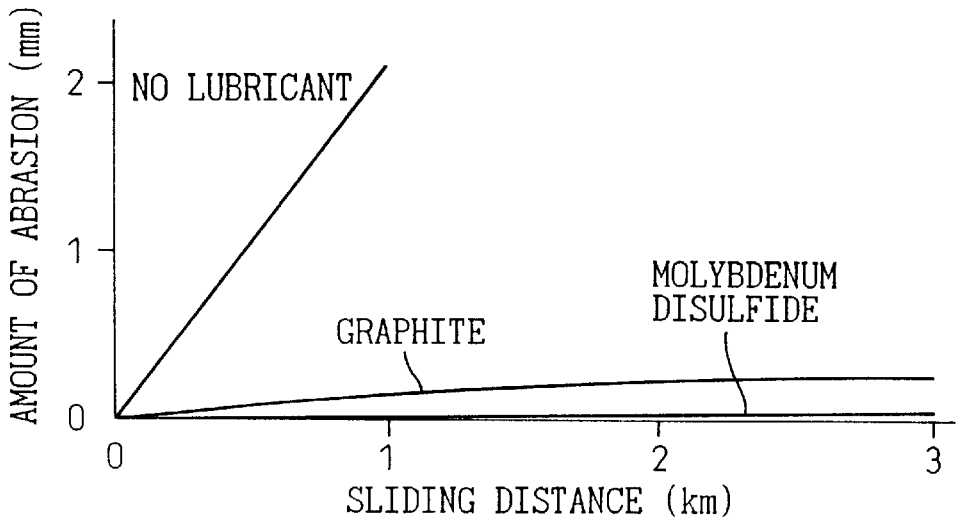
FIG. 20 is a graph showing a relationship between the sliding distance and the amount of abrasion of the ceramic plate in Example 2.

FIG. 19 shows an amount of abrasion of the end surface of the cooling drum a this time. FIG. 20 shows an amount of abrasion of the abrasion surface of the ceramic member at this time. In the above cases, solid lubricant was used, and measurement was made at each sliding distance of 1 km. As can be seen on Table 1, according to the present invention, an amount of abrasion of the sliding surface of the drum end surface or an amount of abrasion of the abrasion surface of the ceramic member was remarkably reduced as compared with an amount of abrasion of Comparative Example.

TABLE 1

| | In the case of sliding by a distance of 1 km | In the case of sliding by a distance of 2 km | In the case of sliding by a distance of 3 km |
|---|---|---|---|
| Amount of abrasion of the drum end surface in the case of using graphite | 3 μm | 4 μm | 6 μm |
| Amount of abrasion of the drum end surface in the case of using molybdenum disulfide | 1 μm | 2 μm | 2 μm |
| Amount of abrasion of the ceramic plate in the case of using graphite | 0.13 mm | 0.21 mm | 0.26 mm |
| Amount of abrasion of the ceramic plate in the case of using molybdenum disulfide | 0.02 mm | 0.03 mm | 0.04 mm |

The reason why the amount of abrasion in the case of the present invention is less than that of Comparative Example is considered to be as follows. According to the present invention, while the guide pipe is being cooled, solid lubricant is fed through the guide pipe. Due to the foregoing, the following effects can be provided.

(1) Lubricating effect can be accelerated when the sliding surface of the cooling drum slides on the abrasion surface of the ceramic member.

(2) Surface temperature of the abrasion surface of the ceramic member is lowered.

(3) Occurrence of irregularities on the sliding surface of the cooling drum can be suppressed.

Next, investigation was made into a case in which the same continuous strip casting apparatus as that of the above example was used and solid lubricant of molybdenum disulfide was used while $N_2$ gas was made to flow in the guide pipe under the same condition. As a result of the investigation, it was possible to obtain the same excellent lubricating effect as that of a case in which graphite was used as solid lubricant and the guide pipe was water-cooled wherein $N_2$ gas was not made to flow in the guide pipe.

On the other hand, when the guide pipe was not water-cooled and the inside of the guide pipe was filled with the atmosphere and graphite was used as solid lubricant, a sharp oxidizing reaction was caused in graphite. Therefore, graphite was oxidized and worn away. As a result, it was impossible to use this oxidized graphite as solid lubricant. When molybdenum disulfide was used, the same result as that described above was provided. Therefore, it was impossible to use the oxidized molybdenum disulfide as solid lubricant.

Figure 21:
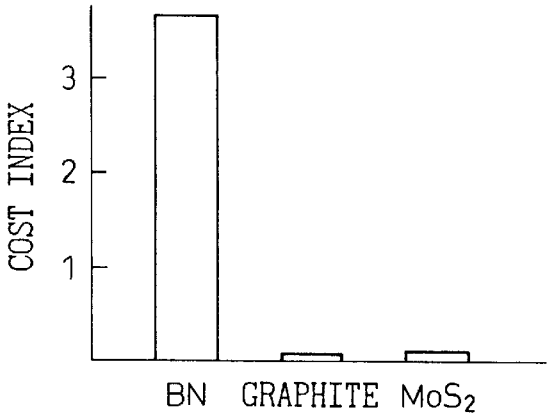
FIG. 21 is a graph showing an index of the cost of the consumed solid lubricant in Example 2.

In this connection, FIG. 21 is a graph on which the cost of solid lubricant is expressed by an index in the case where BN, graphite and molybdenum graphite were used as solid lubricant. As can be seen on the graph, when relatively inexpensive solid lubricant is used according to the present invention, the casting cost can be reduced.

Example 3

In this example, solid lubricant was pushed against the drum end surface at a position distant from the side end plate. Solid lubricant of tungsten disulfide was formed into a cylindrical body, the outer diameter of which was 10 mm and the shape of which was kept by wax. In this case, the sliding surface of the cooling drum was subjected to forced lubrication while the pushing surface pressure was maintained at 6 kgf/cm$^2$.

Figure 22:
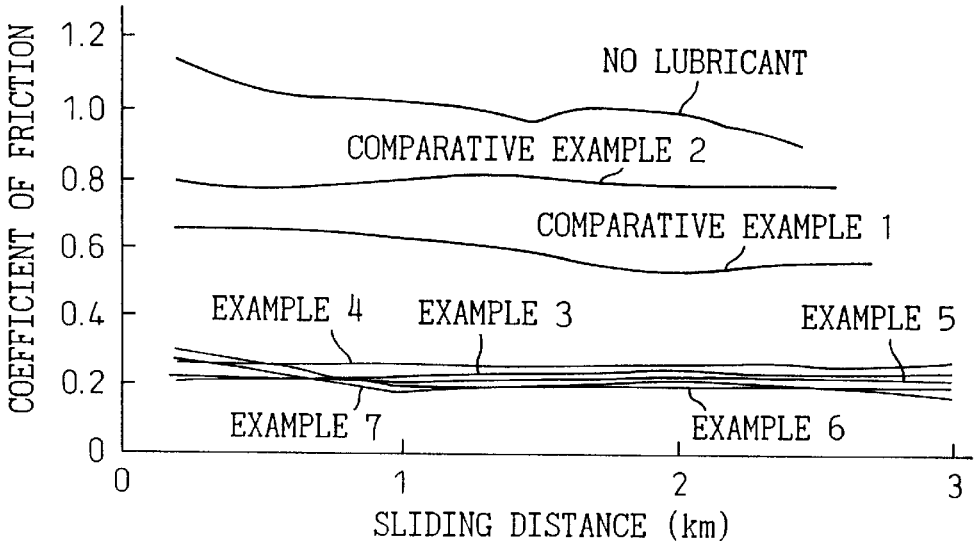
FIG. 22 is a graph showing a relationship between the sliding distance and the coefficient of friction in Examples 3 to 7 and Comparative Examples 1 to 3.

A coefficient of friction between the sliding surface of the cooling drum and the abrasion surface of the ceramic abrasion plate was found by a value of torque of the cooling drum. The thus found coefficient of friction is shown in FIG. 22. As can be seen in FIG. 22, the coefficient of friction was greatly reduced in the present invention compared with a case in which no solid lubricant was used, that is, no lubrication was carried out.

Figure 23:
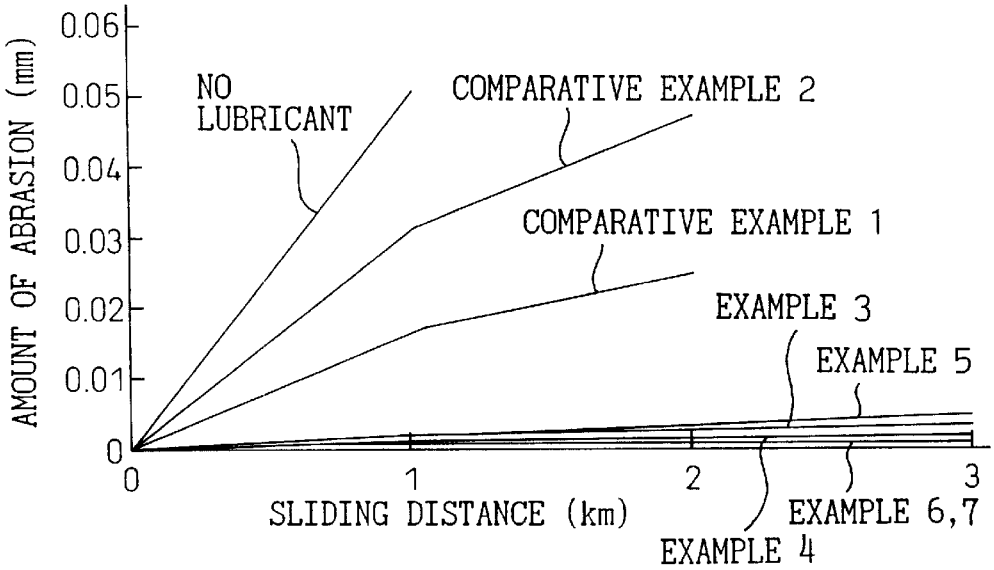
FIG. 23 is a graph showing a relationship between the amount of abrasion of the sliding surface of the drum and the sliding distance in Examples 3 to 7 and Comparative Examples 1 to 3.
Figure 24:
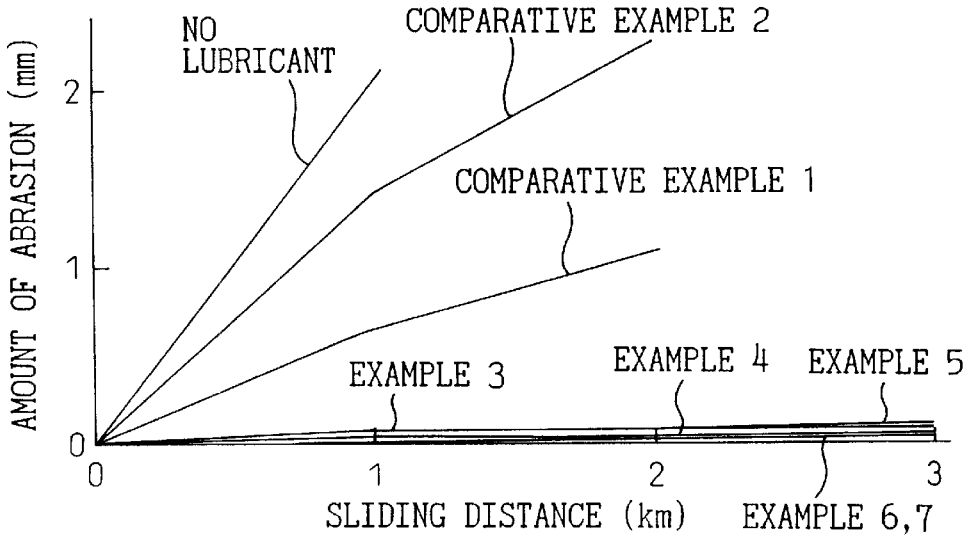
FIG. 24 is a graph showing a relationship between the amount of abrasion of the ceramic plate and the sliding distance in Examples 3 to 7 and Comparative Examples 1 to 3.

FIG. 23 is a graph showing an amount of abrasion of the sliding surface of the drum, wherein the amount of abrasion was measured every 1 km of sliding distance. FIG. 24 is a graph showing an amount of abrasion of the abrasion surface of the ceramic plate, wherein the amount of abrasion was measured every 1 km of sliding distance. When the present invention was applied, amounts of abrasion of both the sliding surface of the drum end surface and the abrasion surface of the ceramic plate were remarkably reduced as compared with a case in which no solid lubricant was used. The reason why the amounts of abrasion were reduced is considered as follows.

(1) According to the present invention, the lubricating effect was accelerated.

(2) According to the present invention, the surface temperature was lowered.

(3) According to the present invention, irregularities on the sliding surface of the cooling drum were decreased.

Example 4

In Example 4, the same apparatus and conditions as those of Example 3 were used, and solid lubricant made of BN was used. The results of the test are shown in FIGS. 22, 23 and 24. In the same manner as that of Example 3 in which tungsten disulfide was used as solid lubricant, Example 4 provided an excellent lubricating effect.

Example 5

In this example, a sintered body of BN was used as solid lubricant, and a variable rate type pushing device was used as a lubricant feed device. Other apparatus and conditions were the same as those of Example 3, and solid lubricant was fed at a feeding speed of 0.5 mm/min which corresponded to the pushing surface pressure of 6 kgf/cm$^2$. The results of the test are shown in FIGS. 22, 23 and 24. In this example, the same excellent lubricating effect as that of Example 3 was provided.

Example 6

In this example, the same apparatus and conditions as those of Example 3 were used, and a sintered body of solid lubricant was used which was made in such a manner that a sintered body of BN sintered at a normal pressure, the porosity of which was 45%, was impregnated with rapeseed oil in vacuum. The results of the test are shown in FIGS. 22, 23 and 24. Example 6 shows a lubricating effect higher than the lubricating effects of Examples 3 and 4.

Example 7

In this example, the same apparatus and conditions as those of Example 3 were used, and solid lubricant was made as follows. A through-hole was formed in a rod-shaped hot-press sintered body of BN in the longitudinal direction. In the through-hole, wax of stearic acid was embedded. The result of the test are shown in FIGS. 22, 23 and 24. Example 7 shows a lubricating effect higher than the lubricating effects of Examples 3 and 4. The results are shown on Table 2.

TABLE 2

| | In the case of sliding by a distance of 1 km | In the case of sliding by a distance of 2 km | In the case of sliding by a distance of 3 km |
|---|---|---|---|
| Amount of abrasion of the drum end surface (Example 3) | 2 μm | 3 μm | 4 μm |
| Amount of abrasion of the drum end surface (Example 4) | 1 μm | 1 μm | 2 μm |
| Amount of abrasion of the ceramic plate (Example 3) | 0.07 mm | 0.08 mm | 0.09 mm |
| Amount of abrasion of the ceramic plate (Example 4) | 0.03 mm | 0.03 mm | 0.05 mm |
| Amount of abrasion of the drum end surface (Example 5) | 2 μm | 3 μm | 5 μm |
| Amount of abrasion of the drum end surface (Example 6) | 0 μm | 0 μm | 1 μm |
| Amount of abrasion of the drum end surface (Example 7) | 0 μm | 0 μm | 1 μm |
| Amount of abrasion of the ceramic plate (Example 5) | 0.04 mm | 0.08 mm | 0.09 mm |
| Amount of abrasion of the ceramic plate (Example 6) | 0.02 mm | 0.03 mm | 0.04 mm |
| Amount of abrasion of the ceramic plate (Example 7) | 0.02 mm | 0.03 mm | 0.04 mm |

Comparative Example 1

In this example, a portion of the ceramic plate of the side dam on the inlet side in the rotational direction of the cooling drum was not chamfered but kept in a shape perpendicular to the drum end surface. Other conditions were the same as those of Example 3. Under the above conditions, a casting test was carried out. As a result, the abrasion speed of the ceramic plate was reduced as compared with a case in which no lubrication was conducted, however, it was impossible to provide such a remarkable lubricating effect as that shown in the above examples.

Comparative Example 2

Next, a casting test was carried out under the following conditions. Forced lubrication was conducted in such a manner that the surface pressure to push solid lubricant against the sliding surface of the cooling drum was set at 1 $kgf/cm^2$, and other conditions were the same as those of Example 3. As a result, an amount of lubricant adhering onto the drum end surface was reduced, so that the same remarkable lubricating effect as that of the above example could not be provided.

Comparative Example 3

In this comparative example, a casting test was carried out as follows. Surface pressure to push solid lubricant against the sliding surface of the cooling drum was kept at 20 $kgf/cm^2$so as to conduct forced lubrication, and other conditions are the same as those of Example 3. As a result of the test, although lubricant adhered onto the end surface of the cooling drum in a good condition, molten steel intruded in the process of casting. Therefore, the casting operation was stopped in the middle. Inventors made investigation into the thus obtained strip. As a result of the investigation, it was found that lubricant concentrated in the end portions of the sheet bars in the form of inclusion. Due to the inclusion, the strip were defective.

INDUSTRIAL APPLICABILITY

As explained above, according to the present invention, the casting time can be extended when solid lubricant is used, and further oscillation of the side dam can be prevented since the coefficient of friction of the sliding surface is reduced, so that life of the cooling drum end surface or the ceramic plate can be extended. Therefore, it is possible to stably conduct continuous strip casting over a long period of time.

What is claimed is:

1. A twin drum type continuous strip casting apparatus comprising: a pair of cooling drums; a pair of side dams arranged coming into contact with end surfaces of the cooling drums; a molten metal pool for accommodating molten metal, the molten metal pool being formed by the cooling drums and the side dams, wherein molten metal is poured into the molten metal pool and cooled and solidified on rotational circumferential surfaces of the cooling drums; and a lubricating mechanism for pushing solid lubricant against a sliding surface of the cooling drum, on which the side dam slides, so as to feed solid lubricant continuously, wherein a contact angle of the side dam and the end surface of the cooling drum in the rear of a position where solid lubricant is pushed against the sliding surface of the cooling drum is an acute angle or a configuration of a portion of the side dam is formed into a circular arc shape.

2. A twin drum type continuous strip casting apparatus according to claim 1, further comprising a guide pipe for guiding solid lubricant onto the sliding surface when solid lubricant is fed, the guide pipe including a water cooling means.

3. A method of continuous strip casting by the twin drum type continuous strip casting apparatus according to claim 2 comprising continuously feeding solid lubricant onto the sliding surface of the cooling drum on which the side dam slides in a reducing gas or inert gas atmosphere while intruding reducing gas or inert gas inside the guide pipe.

4. A method of continuous strip casting by the twin drum type continuous strip casting apparatus according to claim 1 comprising the step of pushing solid lubricant against the end surface of the cooling drum at a surface pressure of 2 to 15 $kgf/cm^2$.

5. A method of continuous strip casting by the twin drum type continuous strip casting apparatus according to claim 1 comprising the step of pushing solid lubricant against the end surface of the cooling drum at a pushing speed of 0.1 to 10 mm/min.

6. A method of continuous strip casting according to claim 4, wherein the solid lubricant is a sintered body, comprising pores having the porosity of 2 to 60%, and liquid lubricant in a temperature range in which the solid lubricant is used is impregnated into the pores.

7. A method of continuous strip casting by a twin drum type continuous strip casting apparatus according to claim 4, wherein the solid lubricant is formed into a rod-shaped sintered body, at least one through-hole is formed in the sintered body in a longitudinal direction, and liquid lubricant in a temperature range in which the solid lubricant is used is embedded in the through-hole.

8. A method of continuous strip casting by a twin drum type continuous strip casting apparatus according to claim 4, wherein the solid lubricant is pushed against and fed at a position in the front of a contact position of the end surface of the cooling drum with the side dam and separate from the side dam.

9. A method of continuous strip casting by a twin drum type continuous strip casting apparatus according to claim 4, wherein the solid lubricant is pushed against and fed to a contact position of the end surface of the cooling drum with the side dam.

10. A twin drum type continuous strip casting apparatus comprising: a pair of cooling drums; a pair of side dams made of self-lubricating ceramics, arranged in contact with end surfaces the cooling drums; a molten metal pool for accommodating molten metal, the molten metal pool being formed by the cooling drums and the side dams, wherein molten metal is poured into the molten metal pool and cooled and solidified on rotational circumferential surfaces of the cooling drums; and a lubricating mechanism for pushing solid lubricant against a sliding surface of the cooling drum, on which the side dam slides, so as to feed solid lubricant continuously, wherein a contact angle of the side end plate and the end surface of the cooling drum in the rear of a position where solid lubricant is pushed against the sliding surface of the cooling drum is an acute angle or a configuration of a portion of the side dam is formed into a circular arc shape.

11. A method of continuous strip casting by the twin drum type continuous strip casting apparatus according to claim 10 comprising the step of pushing solid lubricant against the end surface of the cooling drum at a surface pressure of 2 to 15 $kgf/cm^2$.

12. A method of continuous strip casting by the twin drum type continuous strip casting apparatus according to claim 10 comprising the step of pushing solid lubricant against the end surface of the cooling drum at a pushing speed of 0.1 to 10 mm/min.

* * * * *